US008616287B2

(12) United States Patent
Di Renzo

(10) Patent No.: US 8,616,287 B2
(45) Date of Patent: Dec. 31, 2013

(54) APPARATUS FOR IMPROVING WELL SAFETY AND RECOVERY AND INSTALLATION PROCESS THEREOF

(75) Inventor: Domenico Di Renzo, Casirate d'Adda (IT)

(73) Assignee: ENI S.p.A., Rome (IT)

( * ) Notice: Subject to any disclaimer, the term of this patent is extended or adjusted under 35 U.S.C. 154(b) by 132 days.

(21) Appl. No.: 13/000,572

(22) PCT Filed: Jun. 24, 2009

(86) PCT No.: PCT/EP2009/004622

§ 371 (c)(1), (2), (4) Date: Mar. 15, 2011

(87) PCT Pub. No.: WO2009/156168

PCT Pub. Date: Dec. 30, 2009

(65) Prior Publication Data

US 2011/0155387 A1 Jun. 30, 2011

(30) Foreign Application Priority Data

Jun. 26, 2008 (IT) ..... MI12008A1163

(51) Int. Cl.
*E21B 7/12* (2006.01)

(52) U.S. Cl.
USPC ..... 166/338; 166/339; 166/348; 166/360

(58) Field of Classification Search
USPC ..... 166/338, 344, 368, 363, 364, 373, 339, 166/341, 381
See application file for complete search history.

(56) References Cited

U.S. PATENT DOCUMENTS

| | | | | | |
|---|---|---|---|---|---|
| 2,939,533 | A | * | 6/1960 | Coberly | 166/68 |
| 3,100,015 | A | * | 8/1963 | Regan | 166/378 |
| 3,236,301 | A | * | 2/1966 | Johnstone et al. | 166/338 |
| 3,256,937 | A | * | 6/1966 | Haeber et al. | 166/344 |
| 3,301,322 | A | * | 1/1967 | Newsome | 166/339 |
| 3,414,056 | A | * | 12/1968 | Brown et al. | 166/135 |
| 3,481,395 | A | * | 12/1969 | Sizer et al. | 166/363 |
| 5,156,212 | A | | 10/1992 | Bryant | |
| 5,685,373 | A | | 11/1997 | Collins et al. | |
| 2004/0112586 | A1 | | 6/2004 | Matthews et al. | |

FOREIGN PATENT DOCUMENTS

WO 97 05360 2/1997

OTHER PUBLICATIONS

International Search Report issued Nov. 6, 2009 in PCT/EP09/004622 filed Jun. 24, 2009.

* cited by examiner

*Primary Examiner* — Matthew Buck
*Assistant Examiner* — Aaron Lembo
(74) *Attorney, Agent, or Firm* — Oblon, Spivak, McClelland, Maier & Neustadt, L.L.P.

(57) ABSTRACT

Apparatus for improving the safety and recovery of wells to be installed in oil wells comprising a Deep Set Well Head (DSWH), a Casing Receptacle (1), a Deep Set Tubing Hanger (DSTH) (2), Sub-Surface Safety Valves (SSSVs) (12) (13) with one or two independent Control Lines and Connection elements between the DSTH and well head.

9 Claims, 10 Drawing Sheets

APPARATUS FOR IMPROVING WELL SAFETY AND RECOVERY AND INSTALLATION PROCESS THEREOF

The present invention relates to an apparatus and relative installation process for improving the safety and recovery of wells.

The present invention is an innovative system which can be used in any production well for the extraction of oil or gas, whether it is onshore or offshore. The system is designed to protect wells in production from any damage suffered by the well head and immediately underlying parts improving the safety of the well itself.

With respect to the technology currently used, the system is designed for allowing a rapid, convenient and economical re-establishment of the functionality of the well itself, thanks to the possibility of substituting the damaged connection elements. Although the system can be applied in any context, it is particularly suitable for use where there are greater risks of the wells being damaged. It is therefore suitable for onshore wells, for platforms or underwater wells exposed to possible damage due to natural causes such as storms, anomalous waves, typhoons, passage of icebergs, surface ice drifts or accidental events such as fires, explosions, the falling of particularly heavy equipment or damage by impact with ships.

The apparatus for improving the safety and recovery of well forms an innovative safety system with respect to the technologies currently in use, as it improves the safety of wells in production in the case of accidents at the well head.

It adds to the safety level offered by the SSSVs positioned at a suitable depth, a greater intrinsic safety level provided by the SSSVs installed just below the DSTH in a completely safe and protected position with respect to the well head.

The DSTH and two SSSVs form a further safety barrier for the annulus tubing as they are capable of isolating not only the production tubing, but also the annulus. Furthermore, in the case of accidents at the well head, the production tubing remains connected to the DSTH preventing its weight from being discharged onto the packer at the well bottom.

With the traditional safety systems, only the closing of the production tubing is ensured by means of the SSSV, whereas the annulus remains isolated from the reservoir only through the packer.

The main advantage of the system, however, lies in the possibility of recovering and substituting with new elements the possibly damaged well elements, thereby enabling the re-establishment of the well functionality without intervening below the DSWH and DSTH.

As a further advantage, if, for safety reasons, it is not advisable to install equipment for monitoring the production parameters immediately after the christmas tree, instrumentation constructed for being used in the well can be installed with an equivalent functionality, directly on the production tubing connecting the DSTH to the christmas tree. Instruments for monitoring status parameters such as pressure and temperature, or functional instruments such as flow-meters, etc. can therefore be installed in a protected position.

The apparatus, object of the present invention, for improving the safety and recovery of wells to be installed in oil wells comprising a Deep Set Well Head (DSWH) including a Casing Receptacle (1), a Deep Set Tubing Hanger (DSTH) (2), Sub-Surface Safety Valves (SSSVs) (12) (13) with one or two independent Control Lines (24) and Connection elements between the DSTH and well head (6), (20) and (21), and structural connection elements between DSWH and well head (15), (19) and (25), is characterized in that:

a. the Deep Set Well Head (DSWH), placed at a suitable depth, terminates the underlying casings (14), (18) and (27) used for the construction of the well and its elements (1), (14) and (26) are provided with suitable interfaces to mate the extension elements (15), (19) and (25) connecting the traditional well head;

b. the Casing Receptacle (1) housing the DSTH (2) is equipped with:

- Interface for housing the DSTH;
- Interfaces of the hydraulic sealing (5) and mechanical elements (3) for providing a sealing between DSTH and Casing Receptacle;
- Interface (25) for connection to the production casing or riser extension (25);

c. the Deep Set Tubing Hanger (DSTH) (2) is equipped with:

- At least two passages for the production tubings (11) and (21) and for the control of the annulus (20);
- Hydraulic connections and passages for the control lines of the SSSVs (24);
- Upper interface (6) for connection elements (20), (21) and (24) to the well head (Interface group) which allows their disconnection and subsequent reinstallation;
- Interface for the housing of the seals (9) inside the Casing Receptacle;
- Suitable blocking system (8) on the Casing Receptacle based on radially moveable blocking elements or dogs and activated by pressurizing a specific hydraulic device.

d. The connection elements between the DSTH and traditional well head are capable of:

- connecting (21) the production tubing extension (21) to the surface well head;
- connecting the SSSVs (24) to the well head by means of the Control lines;

and are equipped with:

- Suitable interfaces (6) with the DSTH to allow the disconnection and subsequent re-connection;
- Expansion joints (22)(23) to facilitate the installation;
- Blocking system (8) on the DSTH based on radially moveable and hydraulically activated dogs, the casing extension (25) and (15), and Conductor Pipe extension (19) being equipped with connections at a higher height of the DSTH.

In the DSWH, the casings used for the construction of the well can also be equipped with hydraulic seals which isolate the various annulus tubings, the DSWH being connected to the traditional well head by means of risers.

Preferably, a control tubing extension (20) connecting the annulus to the traditional well head can be provided.

The control of the annulus can be without a connection element between the DSTH and traditional production christmas tree.

The sealing interfaces (5) and (9) are preferably made of a metallic material.

Only one control line can be used for controlling both of the SSSVs.

The SSSVs can be integrated in the DSTH: in this case, the SSSVs will no longer consist of the traditional equipment available on the market, but shall be suitably customized to be housed inside the DSTH.

Inside the DSTH there will be suitable holes to substitute the outer casings of the SSSVs. The components of the SSSVs are therefore housed inside these holes.

The casings are preferably terminated and hydraulically isolated in the DSWH, consequently there are no connection between the annuli of the various casings and the surface: in this case the Casing Receptacle can be installed above the DSWH and will be connected to the traditional well head by means of suitable risers.

The system is installed beneath the ground level or sea bottom, and in any case at a safety distance from the well head so that it cannot be damaged as a result of external actions due to mechanical impact or due to the heat of a possible fire of the same well or nearby wells.

The weight of the production tubing is sustained by the DSTH and transmitted to its housing which is part of the DSWH.

Should the well head be damaged, the SSSVs guarantee the complete closing of the well, i.e. the production tubing and annulus tubing.

The Casing Receptacle is housed in a DSWH whose characteristic consists, in addition to terminating the casings used for constructing the well, in allowing the connection and disconnection, and therefore substitution, of the casings/risers connecting it to the surface well head.

The DSWH used is an existing system, technologically consolidated and already present on the market. The integrated version of the apparatus of the present invention is an implementation suitable for the specific requirements of this system.

The DSWH can be configured so that all the connection casings can be present if required by environmental and functional conditions, or they are terminated at the level of the DSWH itself and only the connections held necessary are installed.

Depending on the configuration adopted, the DSWH integrates or does not integrate the sealing elements suitable for sealing the annulus tubings in correspondence with the DSWH itself.

A further object of the present invention relates to the process for installing the apparatus characterized in that it is effected in a single run which also comprises the extension elements together with the production string for completing the well.

In the following description of the patent application, reference is made to 10 figures which represent the same number of schematic drawings; in particular:

All the casings/risings which connect the DSWH to the traditional well head are provided with connection interfaces capable of effecting the structural connection and hydraulic sealing of the elements thanks to the metal to metal sealings.

Above the DSTH there are the connection elements of the production string, annulus control lines and annulus tubing, and the hydraulic control lines of the SSSVs which are connected to the well head.

Figure 3:
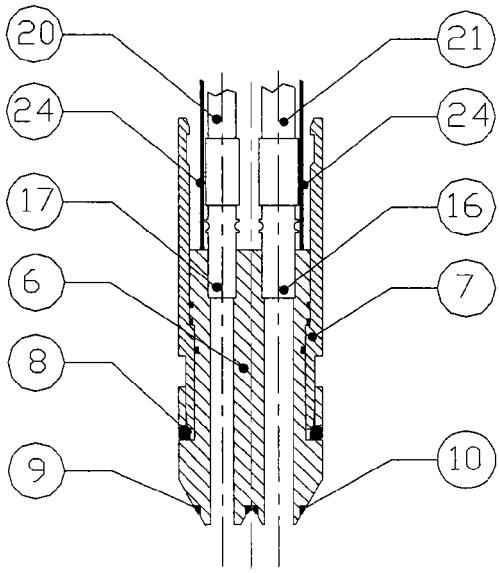
FIG. 3 shows the interface group of the connection elements to the DSTH.

They are connected to the DSTH by means of an Interface Group illustrated in FIG. 3 which can be connected and disconnected from the DSTH when required.

In the case of damage of the well head, the connection elements can therefore be substituted and reinstalled, quickly re-establishing the operativeness of the well, restarting production without ever intervening below the DSWH and without extracting the completion beneath the interface of the DSTH.

Figure 7:
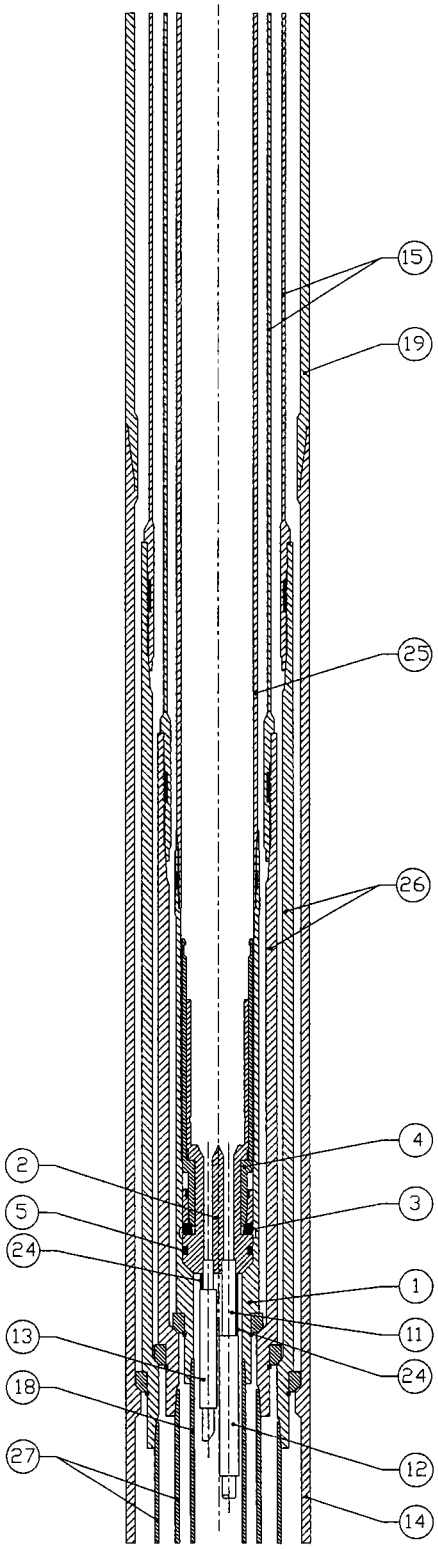
FIG. 7 shows the apparatus installed on the DSWH without the connection elements.
Figure 8:
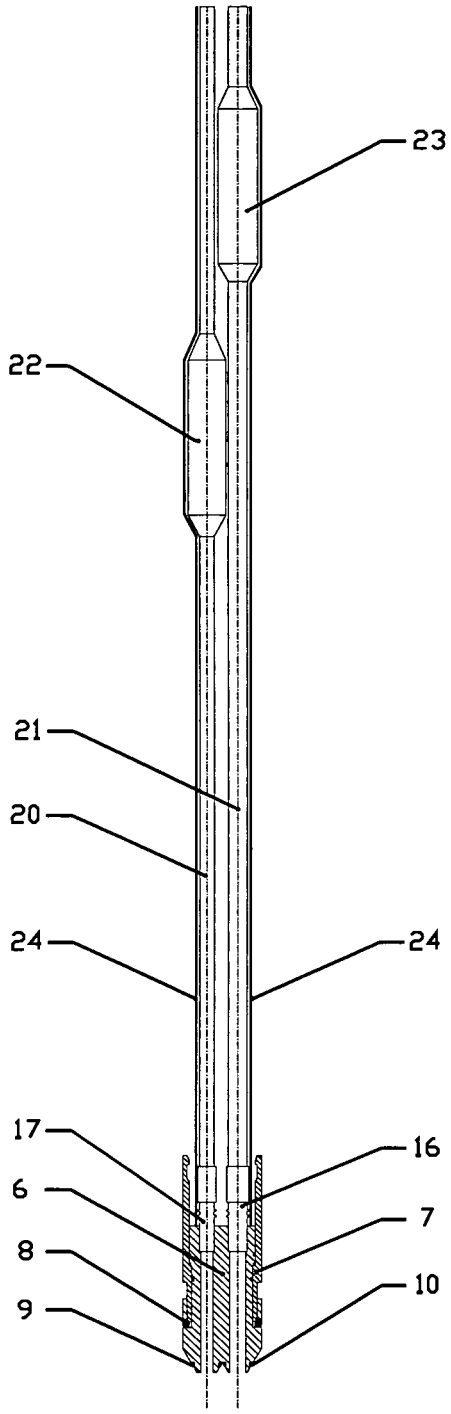
FIG. 8 shows the connection elements.

After suitable replacement of the casings/risers extension elements (FIG. 7) and installation of the traditional well head, the setting-up of the internal extension elements - production tubing, control tubing, hydraulic control lines and what is illustrated in FIG. 8, is effected in a single run, during which all the sealing elements which are of the metallic type (metal to metallic sealing), are also re-established. The two connection tubings are equipped with expansion joints to facilitate their installation. They are also equipped with sealing elements of the metallic type.

The characteristics and advantages of the apparatus according to the present invention will appear more evident from the following illustrative and non-limiting description, referring to the schematic drawings of the enclosed FIGS. 1-11.

The Casing Receptacle (1) is an integral part of the production casing (18). In its interior, there is a shaped profile suitable for being coupled with the Blocking elements (3) contained in the Body (2) of the DSTH. A surface is envisaged on the Casing Receptacle for the metallic sealing (5) which is energized during the setting-up of the system. The Casing Receptacle is connected to the well head by means of the production Casing extension or Riser (25). The DSTH is fixed by pressurizing a hydraulic device which activates a Setting Sleeve (4). The Setting Sleeve is forced to move downwards radially expanding the dogs (3). The weight of the production tubing (11) ensures the energizing force of the metallic seal (5). A blocking device (not schematized) prevents the Setting Sleeve itself from moving backwards, reducing the pressure on the dogs.

The Setting Sleeve (4) is also equipped with an interface allowing the connection to an appropriate retrieving tool capable of effecting the extraction of the DSTH and the whole underlying completion, when required.

Figure 5:
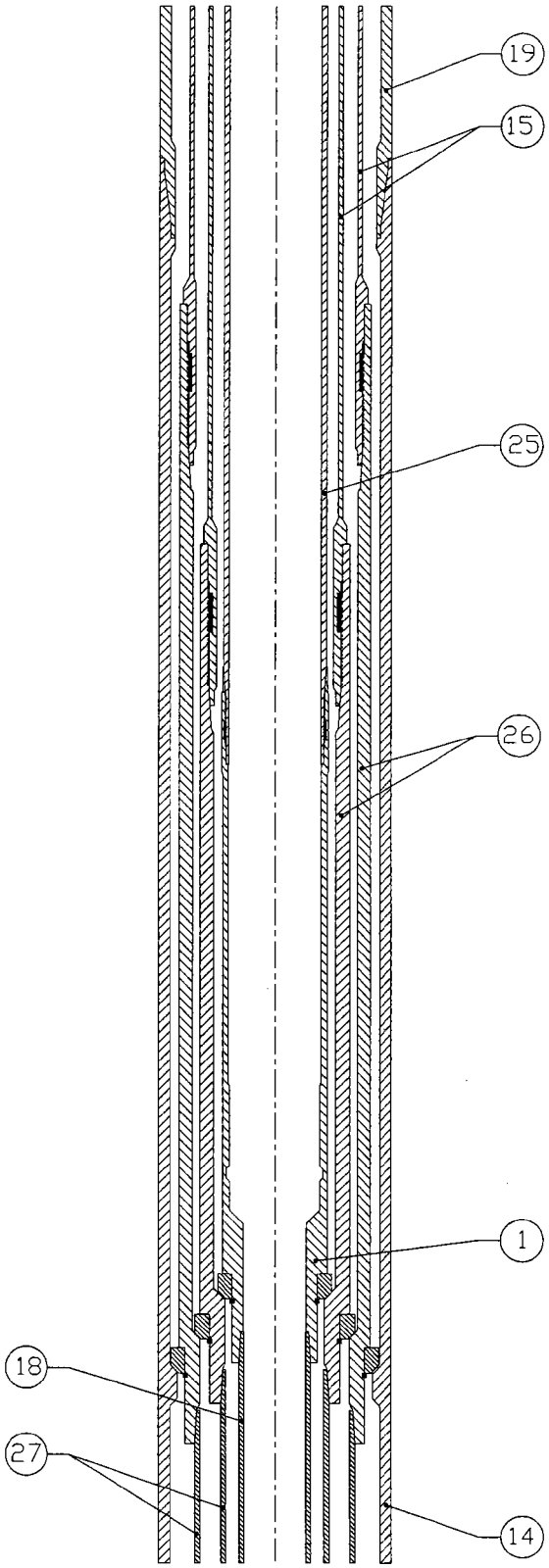
FIG. 5 shows the housing system and support of the casings in the DSWH.

In this case, the well remains open as illustrated in FIG. 5.

The Body (2) is equipped with two main internal passages: the first connected to the production tubing (11) and the second which ensures the control of the annulus. It is also provided with two smaller passages for controlling the SSSVs.

Figure 2:
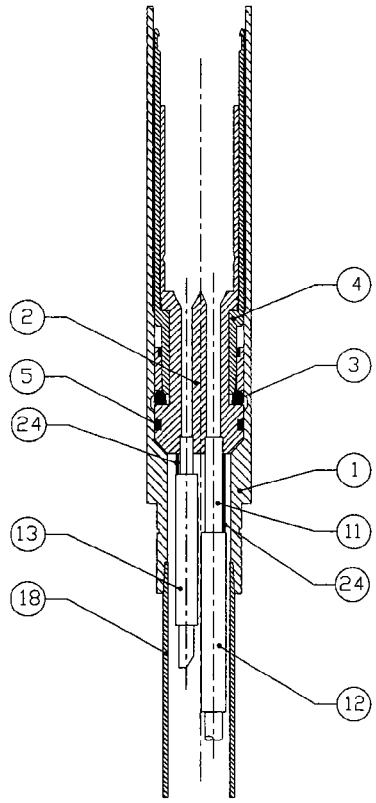
FIG. 2 shows the whole assembly of the DSTH.

FIG. 2 shows a section of the DSTH set without the connection elements (configuration of the well in the case of top workover).

The Body of the DSTH (2) is above interfaced with the Interface Body (6) where the tubings extension (20), (21) and the hydraulic control lines (24) are connected (see also FIG. 3).

Between the Body Interface Group (6) and the Body (2) of the DSTH there are metal to metal seals (9) and (10) to guarantee the isolation of the pressure in the production tubing and annulus and the sealings of the hydraulic control lines (24) of the SSSVs (12) and (13).

The hydraulic control lines (24), coming from the surface well head, run along the tubings extension (20) (21) and are connected to two passages inside the Body of the Interface group (6). These passages are coupled with metal sealings with the corresponding passages inside the DSTH. The control lines which reach the SSSVs are connected to the lower part of the DSTH.

The Body of the Interface group (6) is connected by means of two calibrated Joints (16) and (17) to the Connection tubing extension (21) and to the Annulus tubing extension (20) which, together with the control lines (24), go to the well head. The calibrated joints (16) and (17) provide a weak point defined and calibrated in the connection tubings. Under the action of a defined external force, they yield separating the Tubings from the Interface group, therefore allowing the recovery of these elements without damaging the underlying parts. They are positioned to allow the lowering of a recovery tool, after their activation. The recovery tool, mating the Setting Sleeve (7), enables the recovery of the Interface group which is disconnected from the DSTH.

The Interface Group is installed and fixed inside the DSTH by means of the dogs (8) which expand radially until they become coupled with a shaped profile situated inside the Body of the DSTH (2).

The dogs (8) are set by the Interface Setting Sleeve (7) hydraulically activated.

The elements of the Interface group are illustrated in FIG. 3 which also shows the interfaces between the extension elements and the DSTH.

Figure 4:
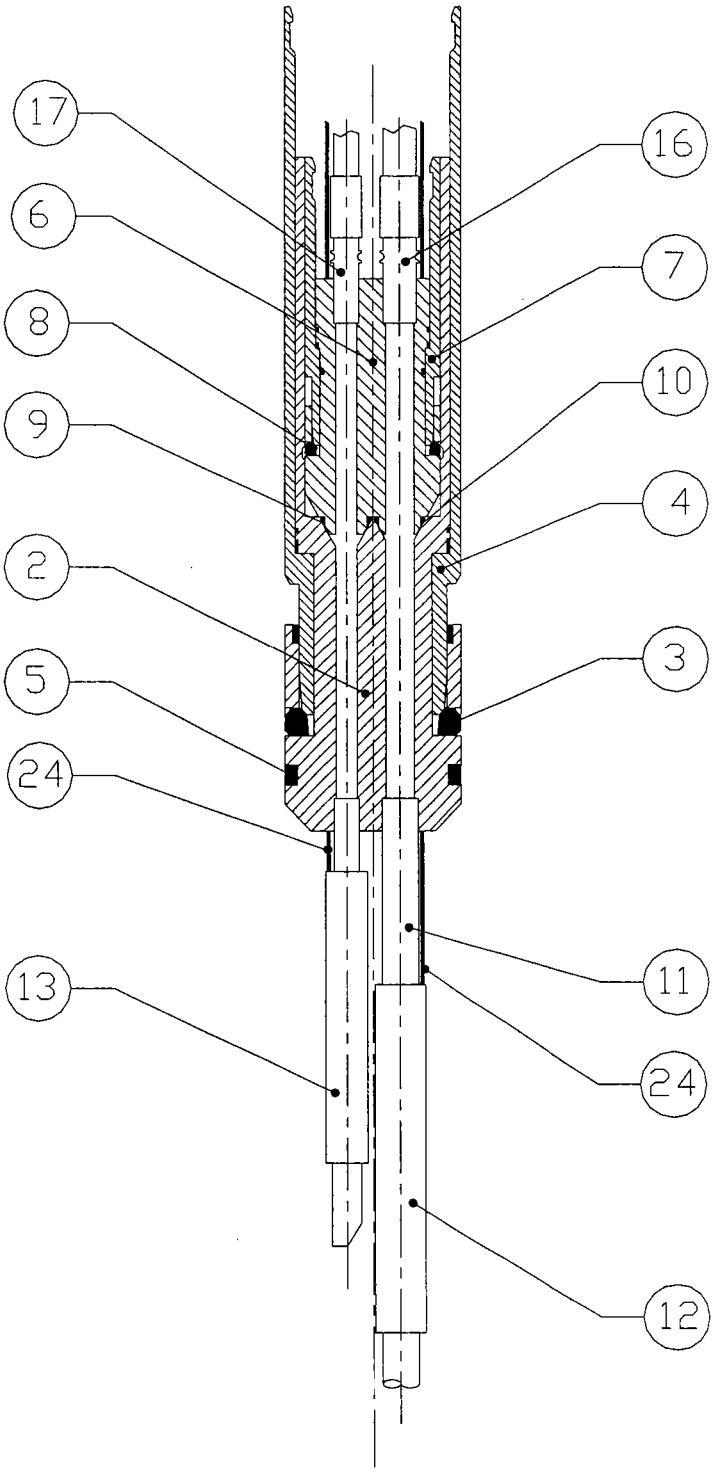
FIG. 4 shows the Interface group assembled on the DSTH inside the Casing Receptacle.

In order to allow an easy installation of the DSTH in the Casing Receptacle, and its connection to the well head, two expansion joints (22) and (23) are present in the production tubing (21) and control of the annulus tubing (20) (See also FIG. 4). These joints have a travel of about one metre and are equipped with metallic sealings. They are blocked in position and their sealings are energized as soon as the christmas tree test has been effected at the end of the installation.

Figure 1:
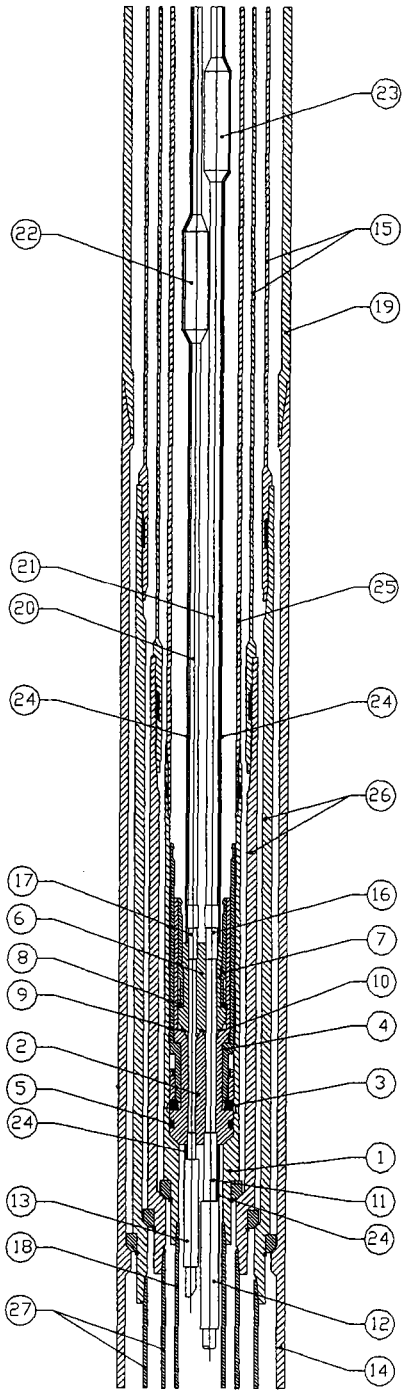
FIG. 1 shows a main section of the apparatus claimed comprising all the main components of the system.

Again FIG. 1 shows the Casing connection interfaces between the DSWH components (1), (14) and (26), and extension elements (25), (15) and (19).

A preferred installation procedure is now described.

Figure 6:
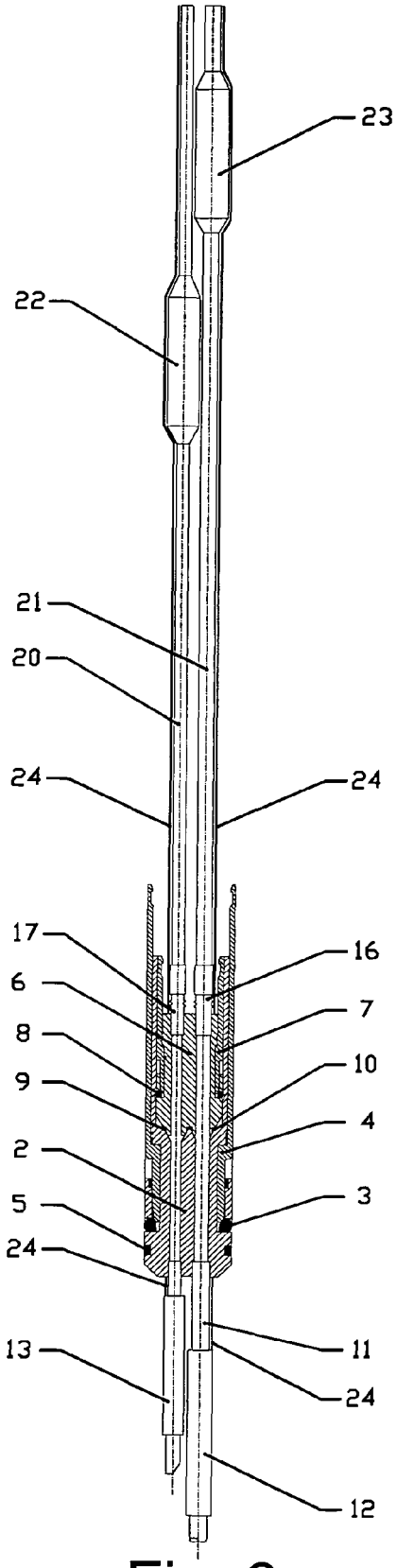
FIG. 6 shows the elements of the system which are lowered and housed in the DSWH of FIG. 5.

The installation and start-up operations of the invention are schematically described below:

- the well is provided with the techniques currently in use until the DSWH installation is completed as shown in FIG. 5. It includes the production casing receptacle (1) and the production case (18);
- the whole unit of FIG. 4 comprising the parts of the system contained in the Casing Receptacle (1), consisting of the DSTH units and Interface group, is preassembled and tested in the workshop;
- the unit consisting of the DSTH, Interface group with the calibrated joints and relative control lines is installed together with the completion and testing preventing the Blocking elements (3) from expanding;
- during the same run, the Expansion joints (22) and (23) are installed, mounted on the production tubing and annulus control tubings until the tubing hanger of the traditional well head can be installed. FIG. 6 shows the elements of the system which are lowered and housed in the DSWH of FIG. 5.
- after effecting the length adjustment of the extension elements so that the DSTH is positioned inside the Casing Receptacle and the Tubing Hanger is installed in the Tubing Spool of the traditional well head, all the connections and tests of the control lines are effected, and the whole unit is installed;
- the traditional well head is installed and tested;
- the DSTH is fixed;
- the expansion joints are activated;
- the whole system, DSTH and expansion joints are pressure tested.

A recovery procedure of the well is now described, using the apparatus according to the invention.

Following damage to the traditional well head or the part immediately below, it is assumed that the extension elements between the DSTH and well head such as: Conductor Pipe (19), Casing or Riser (14), (15) and (25), Tubings (20) and (21), Control lines (24) or those effectively present, have been permanently deformed or divaricated so as to make the well itself unusable.

The SSSVs situated below the DSTH are closed and the outflow of hydrocarbons is interrupted.

Figure 9:
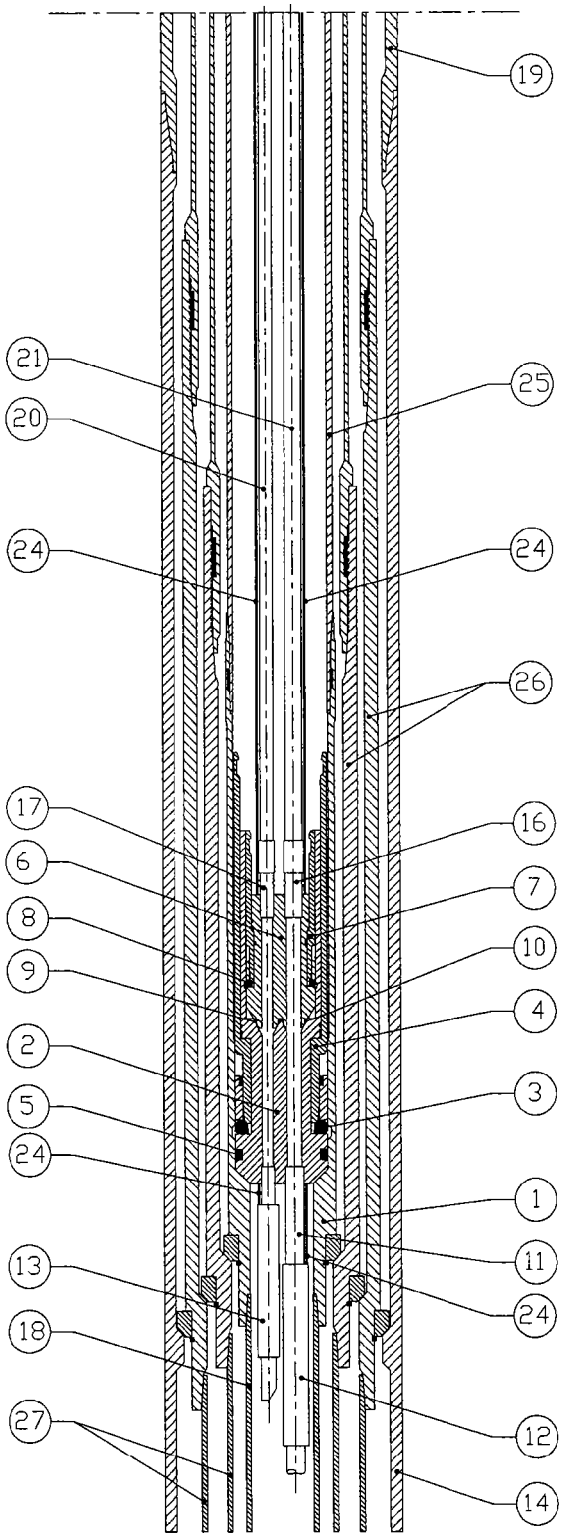
FIG. 9 shows the apparatus installed on the DSWH.
Figure 10:
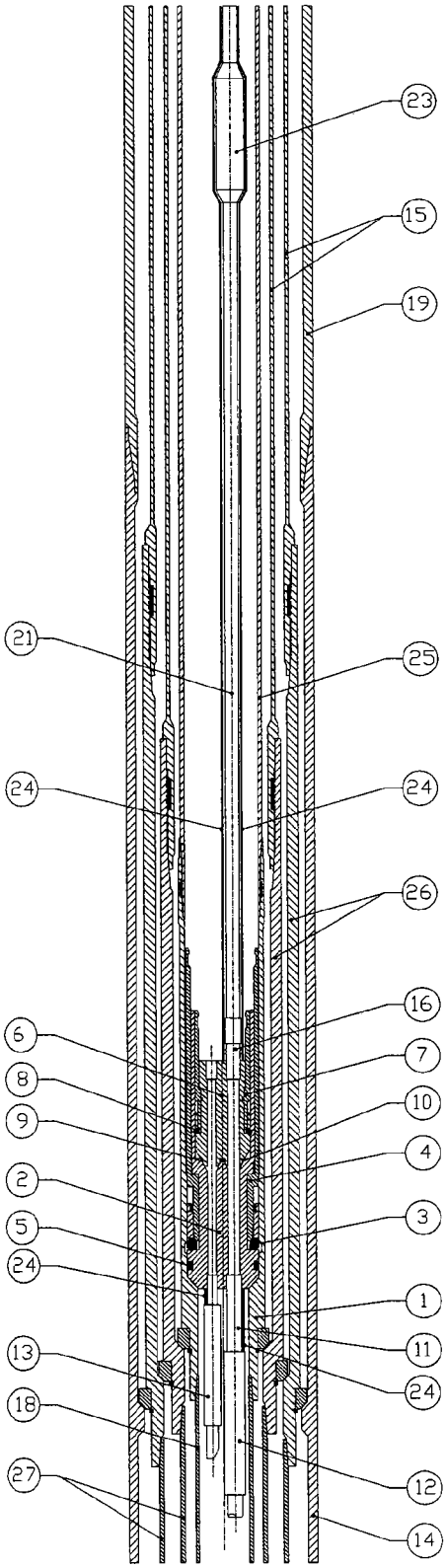
FIG. 10 shows the apparatus in the case of a single connection for the production line.
Figure 11:
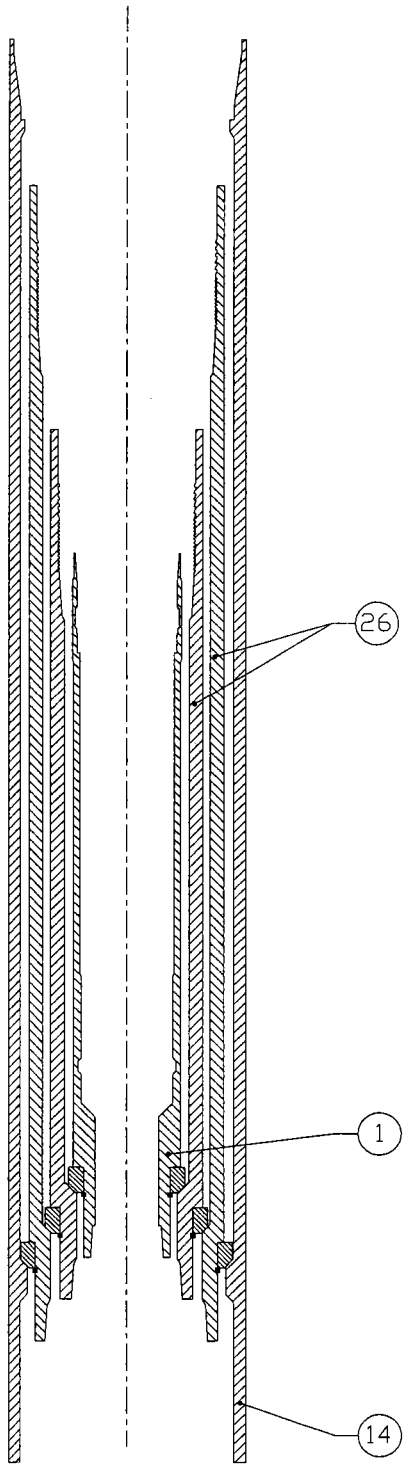
FIG. 11 shows the DSWH components.

The operations which must be effected for re-establishing the structural and functional integrity of the well are schematically described hereunder:

- Using the possible modes and techniques, all the casings/risers and tubings must be cut to such a level that the underlying sections are completely sound (FIG. 9). The damaged parts must be removed.
- Using specific tools, the undamaged part of the Conductor pipe extension is removed by disconnecting the related joint. The conductor pipe extension is then completely reintegrated.
- The other casings/risers are recovered and reintegrated so that the traditional well head is reconstructed
- The two production tubing (21) and annulus control tubing (20) are recovered by pulling action which causes the breakage of the calibrated joints (16) and (17).
- The Interface group is extracted using a specific tool. The configuration illustrated in FIG. 7 is obtained.

At this point the operations necessary for re-establishing the functionality of the well can be performed.

A procedure for re-establishing the functionality of the well using the apparatus according to the invention is now described.

The operations which must be effected for re-establishing the functionality of the well are schematically described hereunder:

- The Interface Group unit of FIG. 3 comprising the Body (6) with the Calibrated Joints (16) and (17), the blocking system on the DSTH and relative control line (24) for controlling the SSSVs, is preassembled and tested.
- During the same run, the expansion joints (22) and (23) mounted on the tubing and the Tubing Hanger are installed. The whole unit is illustrated in FIG. 8.
- After effecting the length adjustment of the interconnection elements (space-out) so that the Interface group is positioned inside the DSTH and the surface Tubing Hanger is installed in the Spool, all the connections and tests of the control lines are performed and the whole unit is subsequently installed.
- The traditional well head is installed and tested.
- The Interface Body (6) is fixed and the seals elements are activated.
- The expansion joints are activated.
- The whole system, DSTH and expansion joints, is tested.
- The functionality of the well is thus re-established.

The invention claimed is:

1. An apparatus for improving the safety and recovery of wells to be installed in oil wells comprising:

- a Deep Set Well Head (DSWH), situated at a first depth, configured to terminate underlying casings used for construction of the well and including disconnection and reconnection system with extension casings or risers for connecting with with the well head;

a Casing Receptacle housing a Deep Set Tubing Hangar (DSTH) and including a first interface for housing the DSTH;

a plurality of second interfaces for providing a sealing between the DSTH and the Casing Receptacle; and a third interface for connection to a production casing or riser;

the DSTH including:

at least two passages for production tubing and for annulus tubing;

hydraulic connections and passages for control of Sub Surface Safety Valves (SSSVs);

a fourth interface for extension elements to the well head which allows for disconnection and subsequent reinstallation of the extension elements;

a fifth interface for housing seals inside the Casing Receptacle; and a blocking system on the Casing Receptacle based on radially movable dog elements, which are configured to be activated by pressurizing a hydraulic device; and extension elements between the DSTH and the well head are configured to connect the production tubing to a surface well head, and connect the SSSVs to the well head via Control lines, the extension elements including:

connection interfaces with the DSTH to allow for disconnection and subsequent re-connection of the DSTH to the well head; and a plurality of expansion joints.

2. The apparatus according to claim 1, wherein the casings include hydraulic seals which isolate the annulus tubing, and the DSWH is connected to the well head by a plurality of risers.

3. The apparatus according to claim 1, further comprising: a connection element configured to connect control tubing of an annulus to the surface well head.

4. The apparatus according to claim 1, wherein the plurality of second interfaces are made of a metallic material.

5. The apparatus according to claim 1, further comprising: a control line configured to control the SSSVs.

6. The apparatus according to claim 1, wherein control of an annulus is without a connection element between the DSTH and a traditional christmas tree.

7. The apparatus according to claim 1, wherein the casings are terminated and hydraulically isolated in the DSWH.

8. The apparatus according to claim 7, wherein the Casing Receptacle is installed above the DSWH.

9. A process for the installation of the apparatus according to at least one of the claims from 1 to 8, wherein it is effected in a single descent which also comprises connection elements for the completion of the well.

* * * * *

UNITED STATES PATENT AND TRADEMARK OFFICE

CERTIFICATE OF CORRECTION

PATENT NO. : 8,616,287 B2
APPLICATION NO. : 13/000572
DATED : December 31, 2013
INVENTOR(S) : Domenico Di Renzo It is certified that error appears in the above-identified patent and that said Letters Patent is hereby corrected as shown below:

On the title page, Item (30), the Foreign Application Priority data should read:

--(30) Foreign Application Priority Data

Jun. 26, 2008 (IT).....MI2008A001163--

Signed and Sealed this
First Day of April, 2014

Michelle K. Lee

Michelle K. Lee
*Deputy Director of the United States Patent and Trademark Office*